US006857404B1

(12) United States Patent
Liedtke et al.

(10) Patent No.: US 6,857,404 B1
(45) Date of Patent: Feb. 22, 2005

(54) HYDRAULIC ENGINE VALVE ACTUATOR

(75) Inventors: Jennifer L. Liedtke, Rochester, MI (US); Thomas E. Wenzel, Davison, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/635,095

(22) Filed: Aug. 6, 2003

(51) Int. Cl.[7] ..... F01L 9/02
(52) U.S. Cl. ..... 123/90.12; 91/169
(58) Field of Search ..... 123/90.12; 92/5 Z, 92/5 R, 171.1, 169; 137/554; 251/63.4; 91/169

(56) References Cited

U.S. PATENT DOCUMENTS 4,050,359 A * 9/1977 Mayer ..... 92/113
4,162,616 A * 7/1979 Hayashida ..... 60/533
2002/0157531 A1 * 10/2002 Kadlicko ..... 92/5 R
2004/0050349 A1 * 3/2004 Leman et al. ..... 123/90.12

* cited by examiner

*Primary Examiner*—Thomas Denion
*Assistant Examiner*—Zelalem Eshete
(74) *Attorney, Agent, or Firm*—Leslie C. Hodges

(57) ABSTRACT

An integrated hydraulic valve actuator for use in a camless internal combustion engine. The valve actuator includes a separate bolt-on housing defining a through opening receiving a cylindrical liner. The liner internally defines an internal cylinder providing a riding surface, which coaxially surrounds an outer surface of a tubular boost piston. The boost piston defines an inner cylinder, which provides a riding surface for a drive piston fitted within the inner cylinder of the boost piston. The pistons are axially reciprocable within the liner cylinder. A piston position sensor extends radially into the housing and engages a cam on the drive piston to relay the position of the drive piston to a controller. The actuator is preassembled and the housing is attached to an engine cylinder head or cylinder head supply manifold to operate an associated exhaust or intake valve.

11 Claims, 4 Drawing Sheets

HYDRAULIC ENGINE VALVE ACTUATOR

TECHNICAL FIELD

This invention relates to engine valve actuating apparatus and more particularly to a hydraulic engine valve actuator integrated in a separate housing assembly.

BACKGROUND OF THE INVENTION

Piston type internal combustion engines generally utilize mechanically driven camshafts and valve gear for operation of intake and exhaust valves. Electric and hydraulic valve actuators have also been proposed in order to provide improved control of valve actuation and timing.

A hydraulic valve system may comprise a hydraulic pump, a controller, a hydraulic fluid manifold, and one or more pistons reciprocable in a hydraulic cylinder provided in the hydraulic fluid manifold. The manifold delivers hydraulic fluid to the hydraulic cylinder to reciprocate the pistons and actuate an associated intake or exhaust valve. A position sensor may also be mounted to the manifold to feed back the valve position to the controller.

Mounting of the hydraulic cylinder and pistons and the position sensor in the manifold increases its complexity and complicates assembly, disassembly and serviceability of the assembly. Modification of the hydraulic components is also complicated by the expense of changes required in design and manufacture of the manifold. A more cost effective and serviceable hydraulic valve actuator for engine valves was desired.

SUMMARY OF THE INVENTION

The present invention provides an integrated hydraulic valve actuator for an internal combustion engine. The valve actuator includes a separate bolt-on housing which contains hydraulic pistons and other tiny and difficult to manipulate parts to aid in the assembly, disassembly and service of the actuator. Additionally, the housing can accommodate a variety of interchangeable parts for use in different engine applications.

To utilize the present invention, a hydraulic supply manifold is machined to accommodate a plurality of integrated hydraulic valve actuators. Each actuator includes a housing mountable to the hydraulic supply manifold and internally defining a through opening formed as a stepped bore. A cylindrical liner is fitted into the bore at one end of the housing. An internal cylinder of the liner provides a riding surface, which coaxially surrounds an outer surface of a tubular boost piston.

The boost piston defines an inner cylinder, which provides a riding surface for a drive piston fitted within the inner cylinder of the boost piston. The boost piston and drive piston are axially reciprocable within the liner. A piston position sensor extends radially into the housing and engages a cam on the drive piston to relay the position of the drive piston to a controller.

In a preferred embodiment, the valve actuator is preassembled and the housing is attached to the hydraulic supply manifold by inserting a portion of the housing into a recess provided in the manifold and fastening the housing to the manifold. Upon subsequent assembly of the hydraulic manifold to an engine cylinder head, the drive piston engages an intake or exhaust valve and the internal cylinder of the liner is positioned to receive hydraulic oil from an associated oil distributor valve in the supply manifold.

In operation, oil is directed to the oil distributor valves, which sequentially distribute pressure oil to the associated valve actuators from the supply manifold. Pressure oil distributed to each valve actuator forces the respective boost piston and the drive piston axially downward in the housing and partially opens the associated engine valve. Part way through the piston stroke, the boost piston engages a stop, while the drive piston continues to move axially downward for a greater distance. The continued motion of the drive piston completes opening of the engine valve. Subsequently, the oil distributor valve reduces the oil pressure in the housing and a valve spring returns the valve to its closed position, thereby moving the drive piston and boost piston back to their original positions against the liner.

Whenever needed, the valve actuator may be removed from the supply manifold for service or replacement to maintain optimal valve performance.

These and other features and advantages of the invention will be more fully understood from the following description of certain specific embodiments of the invention taken together with the accompanying drawings.

DESCRIPTION OF THE PREFERRED EMBODIMENT

Figure 1:
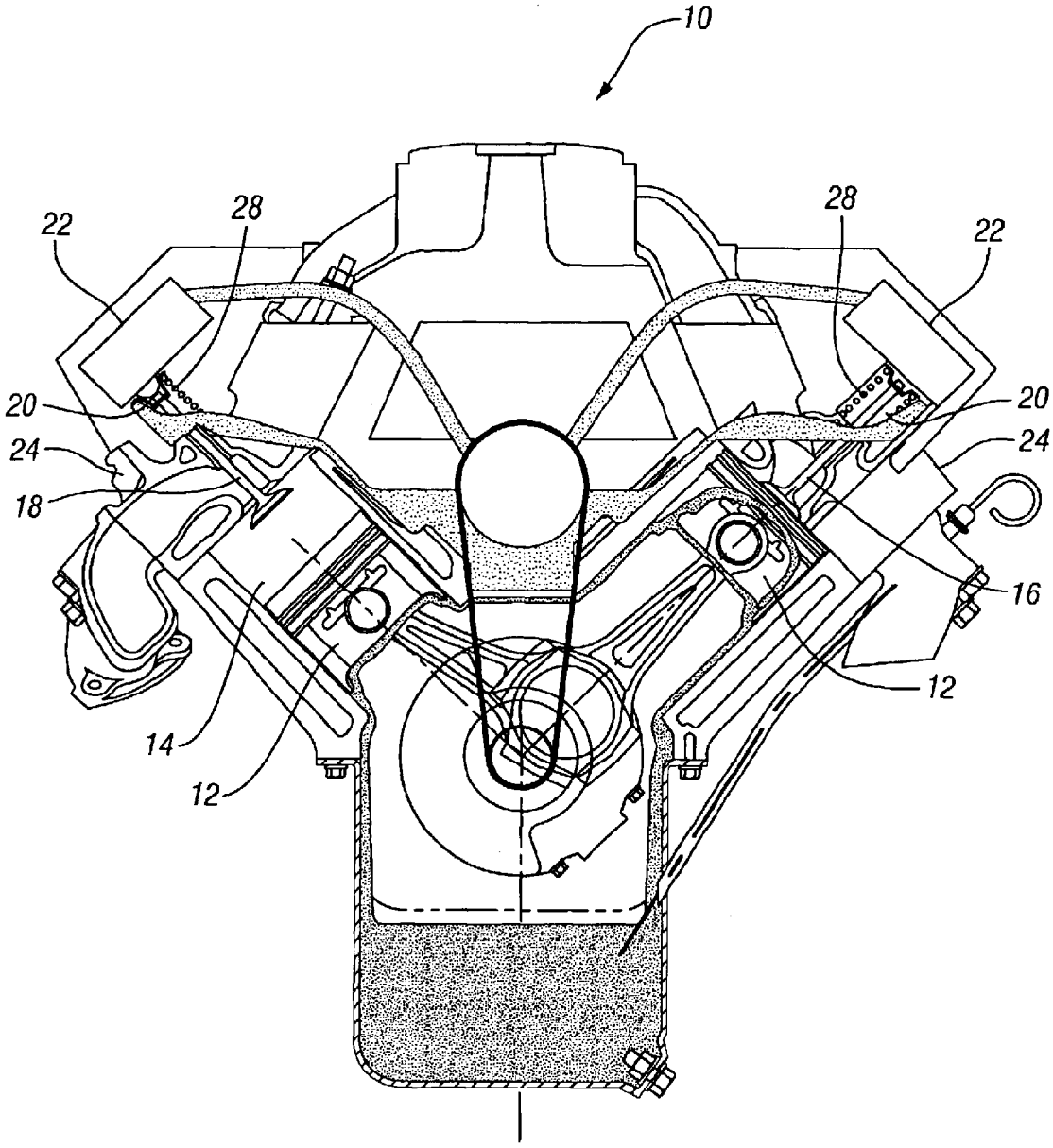
FIG. 1 is a cross-sectioned view of a camless internal combustion engine utilizing integrated hydraulic valve actuators of the invention.

Referring now to FIG. 1 of the drawings in detail, numeral 10 generally indicates a camless internal combustion engine. Engine 10 has a plurality of pistons 12, reciprocable within engine cylinders 14. Each cylinder 14 has associated intake and exhaust valves 16, 18. The valves 16, 18 are hydraulically actuated by valve actuators 20 (FIG. 2) fixed to hydraulic supply manifolds 22 mounted on cylinder heads 24 and closing upper ends of the cylinders 14. The actuators 20 are controlled by oil distributor valves 26 (FIGS. 3,4) which are activated by a controller 27 to deliver pressure oil to or cut off pressure oil from the valve actuators 20. Specifically, the valves 16, 18 are opened by hydraulic actuator pistons, not shown, and are closed by valve springs 28 conventionally mounted on the cylinder heads 24.

Figure 2:
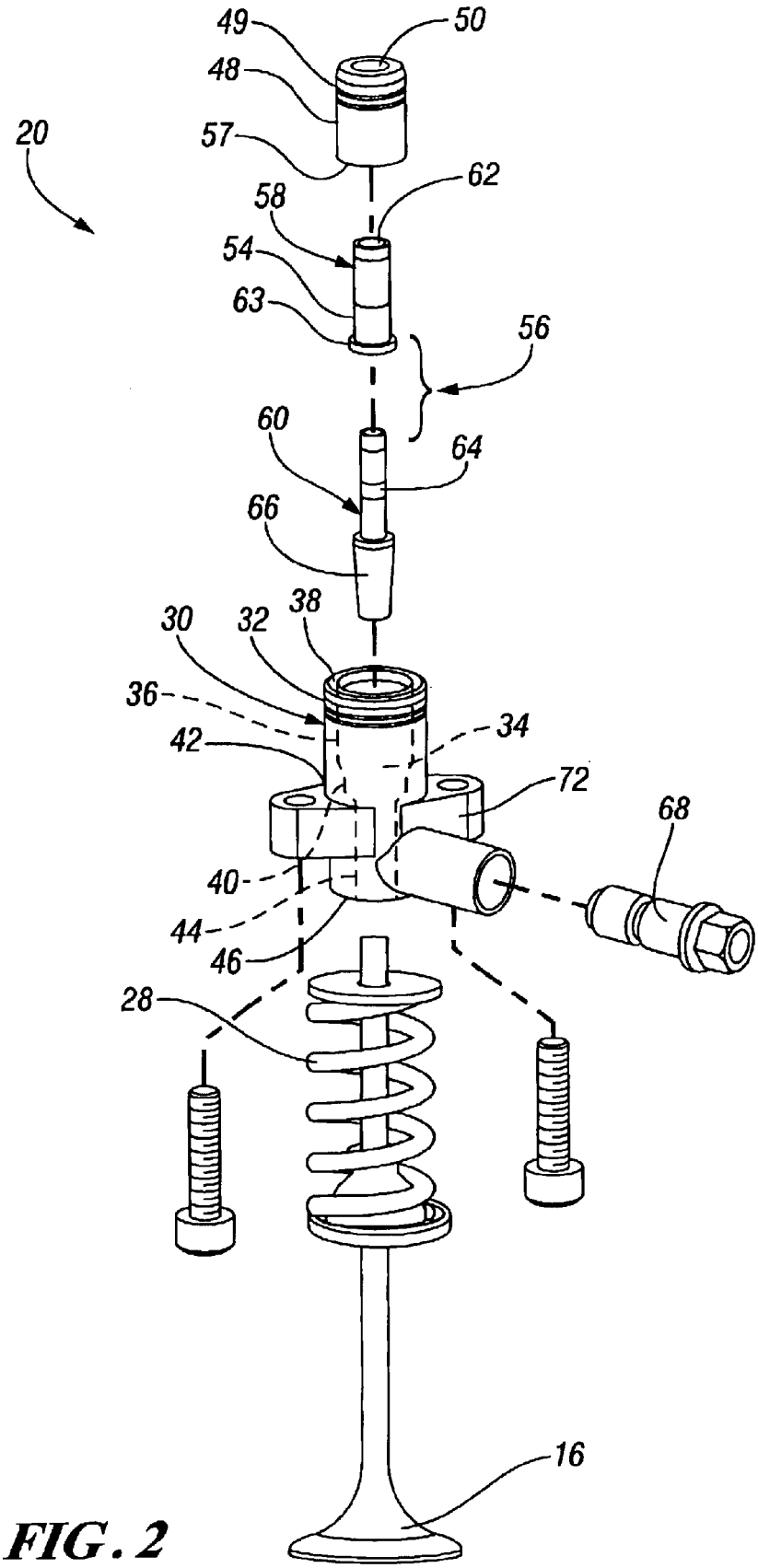
FIG. 2 is an exploded view of a valve actuator assembly according to the present invention.

In accordance with the present invention, the valve actuators 20 comprise integral assemblies, as shown in FIG. 2. Each actuator 20 includes a cylindrical housing 30 which may be formed of metal. The housing 30 carries an external seal ring 32 and internally defines a through opening formed as a stepped bore 34. Bore 34 includes a major diameter 36 extending from an upper portion 38 of the housing to an intermediate diameter 40 near a midportion 42 of the housing 30. A minor diameter 44 extends from the intermediate diameter 40 to a bottom end 46 of the housing. The major diameter 36 is sized to receive a cylindrical liner 48 carrying an external seal ring 49.

The liner 48 may be formed of various metals depending upon the application. The liner 48 internally defines a cylinder 50 which acts as a riding surface for an outer diameter 54 of a piston subassembly 56. The diameter of cylinder 50 may be varied to match the outer diameter 54 of the piston subassembly 56, which reciprocates in cylinder 50. A lower end 57 of the liner 48 also provides an upper stop for the piston subassembly 56.

The piston subassembly 56 comprises the hydraulic actuator pistons, including a tubular boost piston 58 coaxially surrounding a drive piston 60. The boost piston 58 defines an inner riding surface 62 for the drive piston 60. A lower flange 63 of the boost piston is engagable with the stop formed on the lower end 57 of the liner 48 to limit upward travel of the piston subassembly 56. The drive piston 60 has an upper portion 64 received within the riding surface 62 of the boost piston 58 and a tapered lower end or cam 66 extending from upper portion 64. The lower end 66 of the drive piston 60 is engagable with the lower flange 63 of the boost piston 58 to limit upward travel of the drive piston.

The intermediate diameter 40 of the stepped bore is smaller than the exterior of the cylindrical liner 48 to provide an abutment for the cylindrical liner. The intermediate diameter 40 also defines the axial motion or stroke of the boost piston 58 with the piston subassembly 56.

The minor diameter 44 of the stepped bore 34 has a smaller diameter than the boost piston 58, to provide an abutment which stops downward motion of the boost piston 58 at a predetermined point. However, the minor diameter 44 is larger than the lower end 66 of the drive piston 60 to allow axial motion of the piston in the minor diameter 44.

A drive piston position sensor 68 extends radially into the housing 30 near the bottom end 46. The position sensor 68 engages the tapered lower end 66 of the drive piston 60 so that, as the drive piston reciprocates within the housing 30, the position of the drive piston is related to the position of the sensor.

Figure 3:
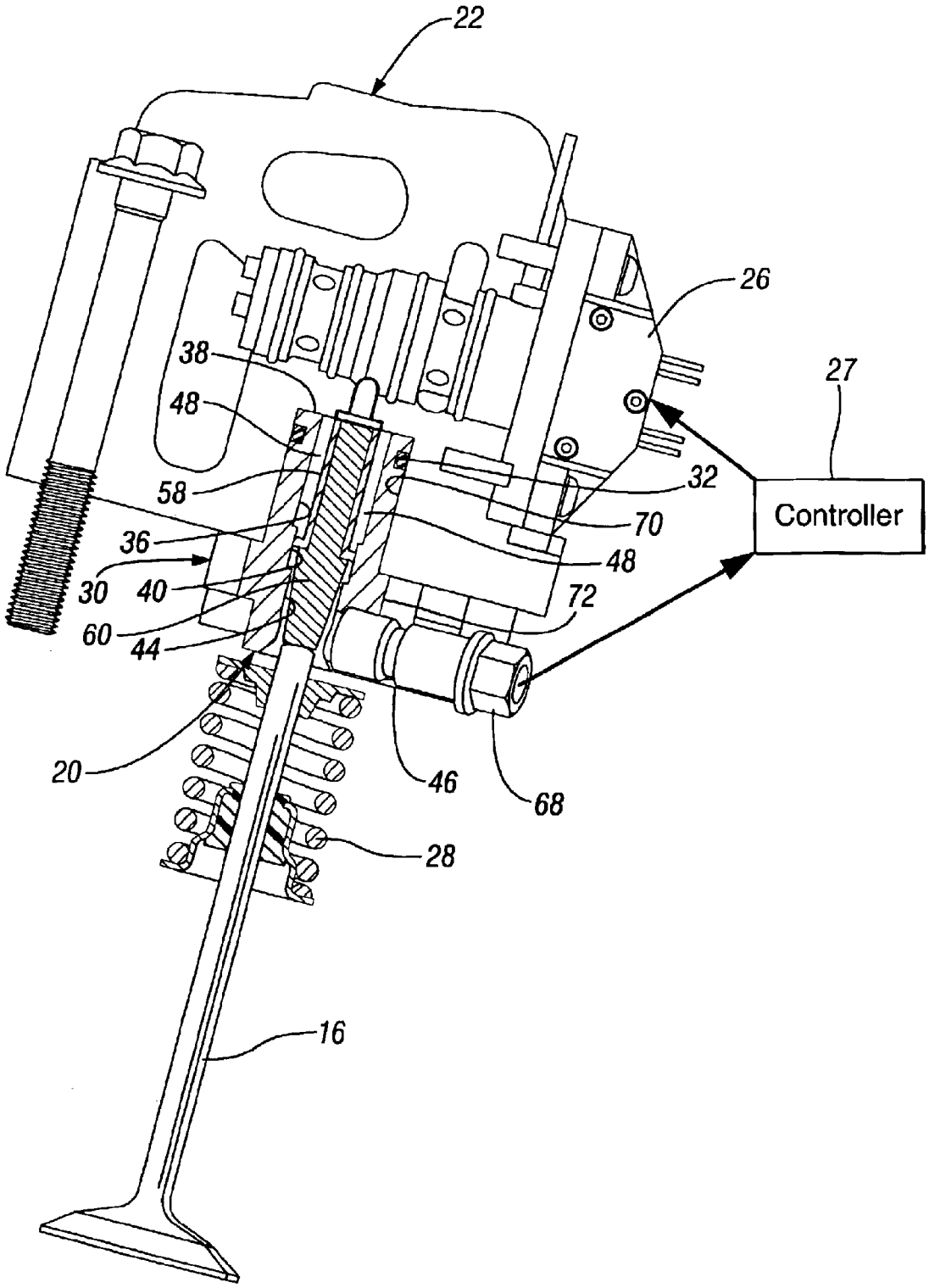
FIG. 3 is a cross-sectional view of a hydraulic valve system with the interior of one actuator.
Figure 4:
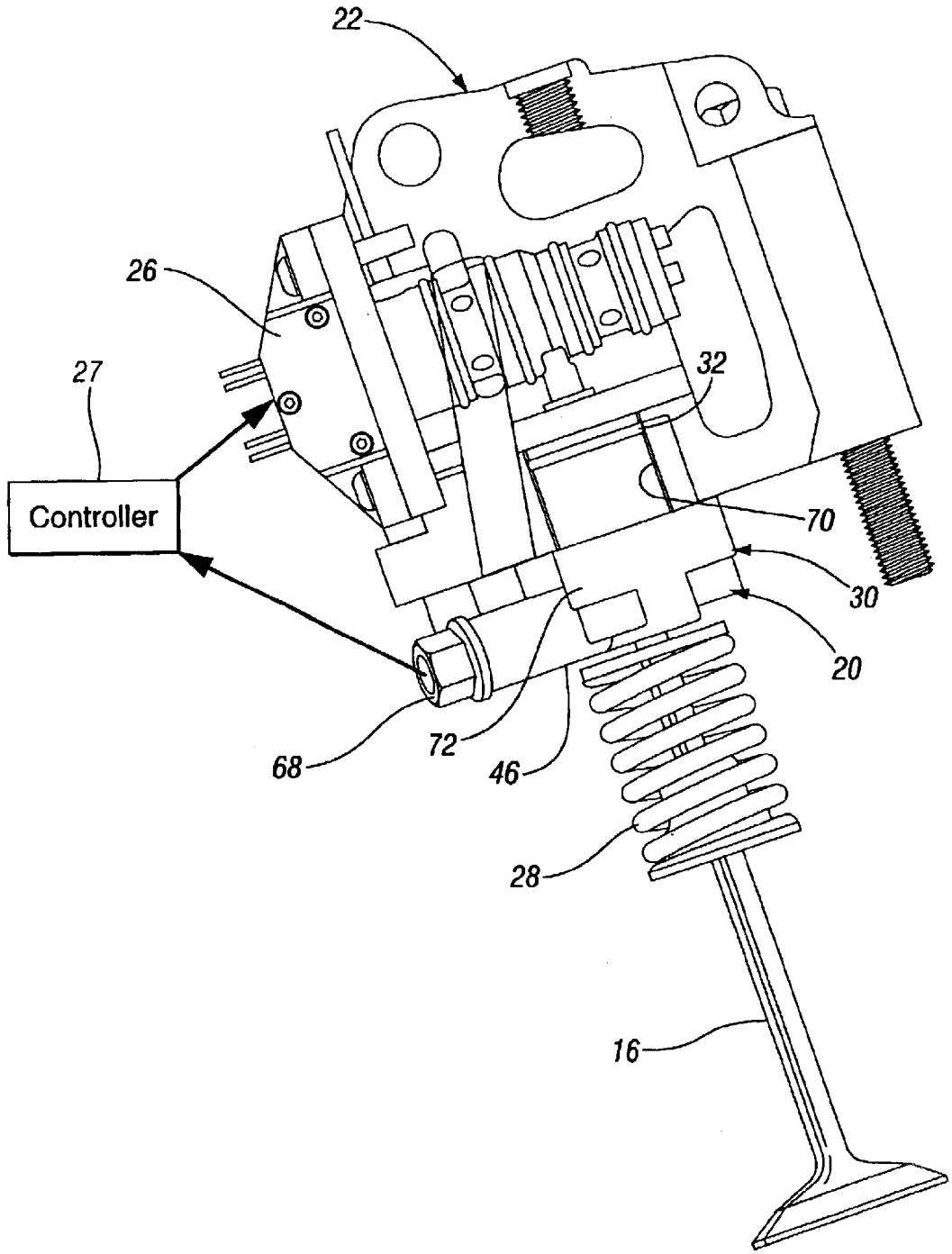
FIG. 4 is a cross-sectional view of the system of FIG. 3 seen from an opposite direction with the exterior of the actuator.

After the valve actuators 20 are assembled, the valve actuators are attached to the hydraulic supply manifolds 22, as shown in FIGS. 3 and 4. In a preferred embodiment of the present invention, each supply manifold 22 has bores 70 for receiving the upper portions 38 of the associated valve actuators 20. The external seal ring 32 carried on each valve actuator housing may be an o-ring provided to seal the associated bore 70 against the leakage of oil. The similar seal 49 is provided on each liner 48 to seal the major diameter 36 of the housing stepped bore against leakage of oil through the bore. Once the valve actuator 20 is inserted into the bore 70, a flange 72 extending from the exterior of the housing 30 is bolted or attached to the supply manifold 22.

In operation, oil is directed to the oil distributor valves 26, which sequentially communicate oil pressure to each valve actuator 20 from the associated hydraulic supply manifold 22. The oil flows into the valve actuator 20 through the internal cylinder 50 of the liner 48. The oil pressure acts against the piston subassembly 56 to force it axially downward within the housing 30, thereby opening the associated intake or exhaust valve 16, 18 against the resistance of the valve spring 28.

As the piston subassembly 56 moves toward the bottom end 46 of the housing 30, the boost piston 58 is stopped by the abutment formed by the minor diameter bore 44. Thereafter, the drive piston continues to move axially downward, at a slower rate, until the associated intake or exhaust valve 16, is fully opened by the force of oil pressure on the smaller drive piston alone. At the desired interval, the oil distributor valve 26 is actuated to reduce the oil pressure to the valve actuator 20, allowing the valve spring 28 to return piston subassembly 56 and the valve 16 or 18 to the closed position.

As the piston subassembly 56 reciprocates within the housing 30, the position sensor 68, relays the position of the drive piston 60 to controller 27. Based upon the position of the drive piston 60 relative to the piston position sensor 68, the controller 27 determines the proper amount of oil pressure required from the oil distributor valve 26 to properly actuate the valve 16.

If desired a valve actuator 20 may be removed from its hydraulic supply manifold for service or replacement. Servicing of the valve actuator 20 is accomplished by removing the liner 48 and piston subassembly 56 from the housing 30. If the liner 48 becomes worn over time, it may be replaced with a new liner. If needed, the piston subassembly 56 may also be replaced. If desired the liner 48 may be replaced with a liner having a larger diameter opening to accommodate a piston subassembly having a larger diameter than the original piston subassembly 56. After the valve actuator 20 is reassembled with new parts, the valve actuator may be reinstalled to the supply manifold 22 and reused.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An integrated hydraulic valve actuator comprising:

a housing internally defining a through opening;

a cylindrical liner received in an upper portion of the housing, the liner internally defining a cylinder and riding surface receiving a reciprocable piston subassembly;

the piston subassembly including a boost piston defining an internal cylinder and a drive piston extending through and reciprocable in the internal cylinder of the boost piston;

the liner cylinder being open to receive pressurized fluid to axially move the piston subassembly within the cylinder; and a drive piston position sensor extending into the housing and engaging a cam on the drive piston to sense the position of the drive piston within the cylinder.

2. A valve actuator according to claim 1 wherein the housing is formed of metal.

3. A valve actuator according to claim 1 wherein the liner is formed of metal.

4. An integrated hydraulic valve actuator comprising:

a housing internally defining a stepped bore having an upper major diameter, a middle intermediate diameter, and a lower minor diameter;

a cylindrical liner received in the major diameter of the stepped bore, the liner internally defining a cylinder and riding surface;

a piston subassembly received in the cylinder for actuating an engine valve, the subassembly including a tubular boost piston defining an internal cylinder and a drive piston reciprocable in the internal cylinder of the boost piston;

the liner cylinder being open to the major diameter of the stepped bore for receiving pressurized fluid to axially move the piston subassembly within the liner cylinder; and a drive piston position sensor extending radially into the housing and operable to determine the position of the drive piston within the cylinder.

5. A valve actuator according to claim 4 wherein the boost piston has a flange engaging lower end of liner to limit upward travel of the piston subassembly.

6. A valve actuator according to claim 4 wherein the flange of the boost piston is engagable with an upper end of the stepped bore minor diameter to limit downward travel of the boost piston.

7. A valve actuator according to claim 4 wherein the drive piston has an upper portion received within the boost piston and a tapered lower end extending from the upper portion.

8. A valve actuator according to claim 4 wherein a tapered lower end of the drive piston is engageable with the boost piston to limit upward travel of the drive piston.

9. A valve actuator according to claim 4 wherein a piston position sensor engages the tapered lower end of the drive piston.

10. An integrated hydraulic valve actuator comprising:

a housing internally defining a through opening;

a removable cylindrical liner received in an upper portion of the housing, the liner internally defining a cylinder and riding surface receiving a reciprocable piston subassembly removable with the liner from the housing;

the piston subassembly including a boost piston defining an internal cylinder and a drive piston extending through and reciprocable in the internal cylinder of the boost piston;

the liner cylinder being open to receive pressurized fluid to axially move the piston subassembly within the cylinder; and a drive piston position sensor extending into the housing and engaging a cam on the drive piston to sense the position of the drive piston within the cylinder.

11. An integrated hydraulic valve actuator comprising:

a housing internally defining a through opening and having an upper portion adapted to be received in a bore of a supply manifold and a flange extending from the housing adapted to attach the housing to the supply manifold;

a cylindrical liner received in an upper portion of the housing, the liner internally defining a cylinder and riding surface receiving a reciprocable piston subassembly;

the piston subassembly including a boost piston defining an internal cylinder and a drive piston extending through and reciprocable in the internal cylinder of the boost piston;

the liner cylinder being open to receive pressurized fluid to axially move the piston subassembly within the cylinder; and a drive piston position sensor extending into the housing and engaging a cam on the drive piston to sense the position of the drive piston within the cylinder.

* * * * *